US005474119A

United States Patent [19]

Jonsson

[11] Patent Number: 5,474,119

[45] Date of Patent: Dec. 12, 1995

[54] METHOD OF AND MOLD FOR CASTING A COMBINED ENGINE BLOCK AND CYLINDER HEAD FOR A TWIN PISTON ENGINE

[75] Inventor: Bo. I. R. Jonsson, Huskvarna, Sweden

[73] Assignee: Aktiebolaget Electrolux, Stockholm, Sweden

[21] Appl. No.: 236,458

[22] Filed: May 2, 1994

[30] Foreign Application Priority Data

May 4, 1993 [SE] Sweden ..... 9301524

[51] Int. Cl.[6] ..... B27D 17/24; B27D 33/04

[52] U.S. Cl. ..... 164/137; 164/340; 164/342; 249/145; 249/176

[58] Field of Search ..... 164/137, 342, 164/340; 249/145, 176

[56] References Cited

U.S. PATENT DOCUMENTS

| | | | |
|---|---|---|---|
| 2,184,603 | 12/1939 | Portmann . | |
| 2,342,900 | 2/1944 | Sandell . | |
| 2,421,884 | 6/1947 | Holmes . | |
| 4,275,689 | 6/1981 | Ray . | |
| 4,301,856 | 11/1981 | DiRosa | 164/342 X |
| 4,858,670 | 8/1989 | Field et al. . | |
| 4,981,168 | 1/1991 | Koch et al. | 164/137 |
| 5,069,266 | 12/1991 | Nakatani et al. | 164/70.1 X |
| 5,351,744 | 10/1994 | Larsson | 164/137 X |

FOREIGN PATENT DOCUMENTS

| | | | |
|---|---|---|---|
| 557617 | 8/1923 | France . | |
| 3543194 | 11/1986 | Germany | 164/340 |
| 61-232053 | 10/1986 | Japan | 164/342 |
| 1-289555 | 11/1989 | Japan | 164/340 |
| 4-59162 | 2/1992 | Japan | 164/342 |
| 4-118165 | 4/1992 | Japan | 164/340 |
| 2193529A | 2/1988 | United Kingdom . | |

*Primary Examiner*—J. Reed Batten, Jr.

*Attorney, Agent, or Firm*—Pearne, Gordon, McCoy & Granger

[57] ABSTRACT

The mold comprises an outer mold part (10) which defines a mold cavity (11). Walls of the outer mold part form the outer surface of the combined engine block and cylinder head. There also are first and second inner mold parts (12, 13) which extend into the mold cavity and are maintained a distance from each other. Each of the first and second inner mold parts have a cylindrical portion (12*a*, 13*a*) which, during the casting procedure, forms the cylinder bores in the engine block. The first and second inner mold parts (12, 13) also each have an upper portion (12*b*, 13*b*) situated above the cylindrical portion. During the casting procedure the upper portions form portions of a combustion chamber common to the cylinder bores. The mold further includes an third inner mold part (15) which extends through the outer mold part (10) and cooperates with the first and second inner mold parts (12, 13) to form the combustion chamber during the casting procedure.

12 Claims, 2 Drawing Sheets

METHOD OF AND MOLD FOR CASTING A COMBINED ENGINE BLOCK AND CYLINDER HEAD FOR A TWIN PISTON ENGINE

BACKGROUND OF THE INVENTION

This invention relates to a press casting method for manufacturing a combined engine block and cylinder head for a twin piston engine, i.e., a piston engine having two cylinders and a common combustion chamber for the cylinders. The invention also relates to a mold for manufacturing such a combined engine block and cylinder head.

DESCRIPTION OF THE RELATED ART

Traditionally, a combined engine block and cylinder head for a small internal combustion engine, i.e., for a single cylinder two-cycle engine, is manufactured of light metal by means of a press casting method. For this production, a steel mold is used. The mold has a mold cavity in which one or more mold parts forming the cylinder bores are inserted before the mold cavity is filled with molten metal. Since each cylinder has a separate combustion chamber, the mold part which forms the combined cylinder and combustion chamber can be shaped as a single detail which can easily be withdrawn from the cast engine block when the metal has solidified.

During recent years, demands for a reduction of engine exhaust gases has resulted in an increased interest in other types of engines. Included in these engines is the so-called twin piston engine which is known, per se, and has a single combustion chamber and a pair of parallel communicating cylinders. See, for example, French Patent No. 557,617 and U.S. Pat. No. 2,184,603, the disclosures of which are expressly incorporated herein in their entireties. This construction is, however, from a manufacturing point of view, considerably more difficult to produce since the mold parts cannot easily be shaped in such a manner that they, at the same time, form the two cylinder bores and the common combustion chamber if it should also be possible to remove all mold parts from the finished detail. This type of engine has, therefore, been manufactured by means of ordinary destructive core technique, by means of extensive machining after casting and/or with the engine block and the cylinder head formed as separate parts.

SUMMARY OF THE INVENTION

The present invention provides a simple manufacturing technique for a twin piston engine.

According to the present invention, a press casting method for producing a combined engine block and cylinder head for a twin piston engine is provided. The engine defines a pair of cylinders having a common combustion chamber wherein the combustion chamber is formed by cooperation between at least three mold parts. Two of the mold parts also each form a cylinder bore while a third mold part abuts the other two mold parts during press casting of the engine.

In further accordance with the present invention, a mold for manufacturing a twin piston engine includes an outer mold part that defines a mold cavity. Walls of the outer mold part form an outside of the combined engine block and cylinder head. First and second inner mold parts are located in the mold cavity and maintained a distance from one another. The first and second inner mold parts each have a cylindrical portion which, during a press casting procedure, forms a cylinder bore. The first and second inner mold parts each have an upper portion above the cylindrical portion. The upper portions of the first and second inner mold parts cooperate with a third inner mold part during the press casting procedure to form a combustion chamber common to the cylinders.

BRIEF DESCRIPTION OF THE DRAWINGS

These and further features of the present invention will be apparent with reference to the following description and drawings wherein.

DETAILED DESCRIPTION OF THE PREFERRED EMBODIMENTS

Figure 1:
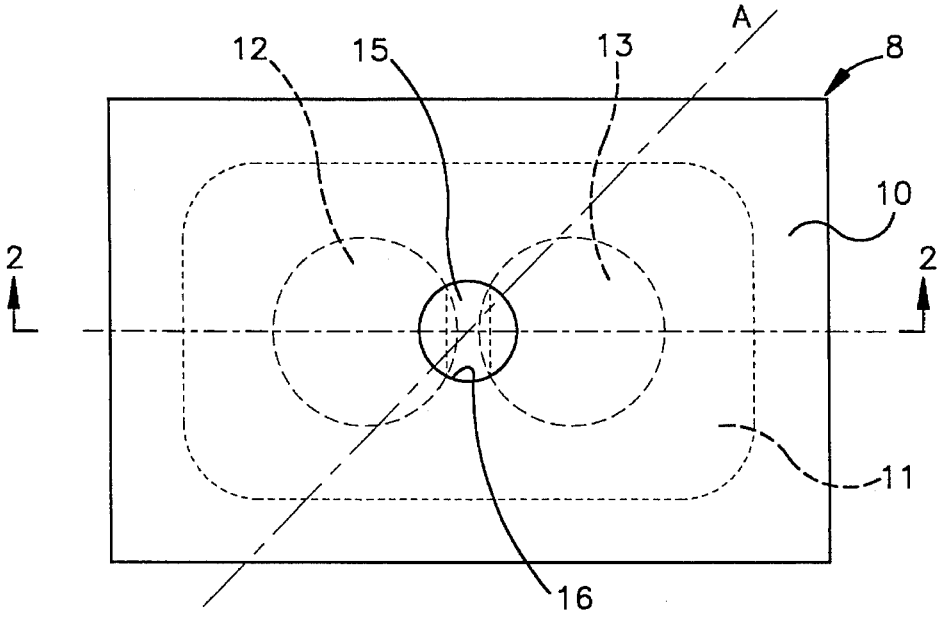
FIG. 1 is a top plan view of a mold according to a first preferred embodiment of the present invention.
Figure 2:
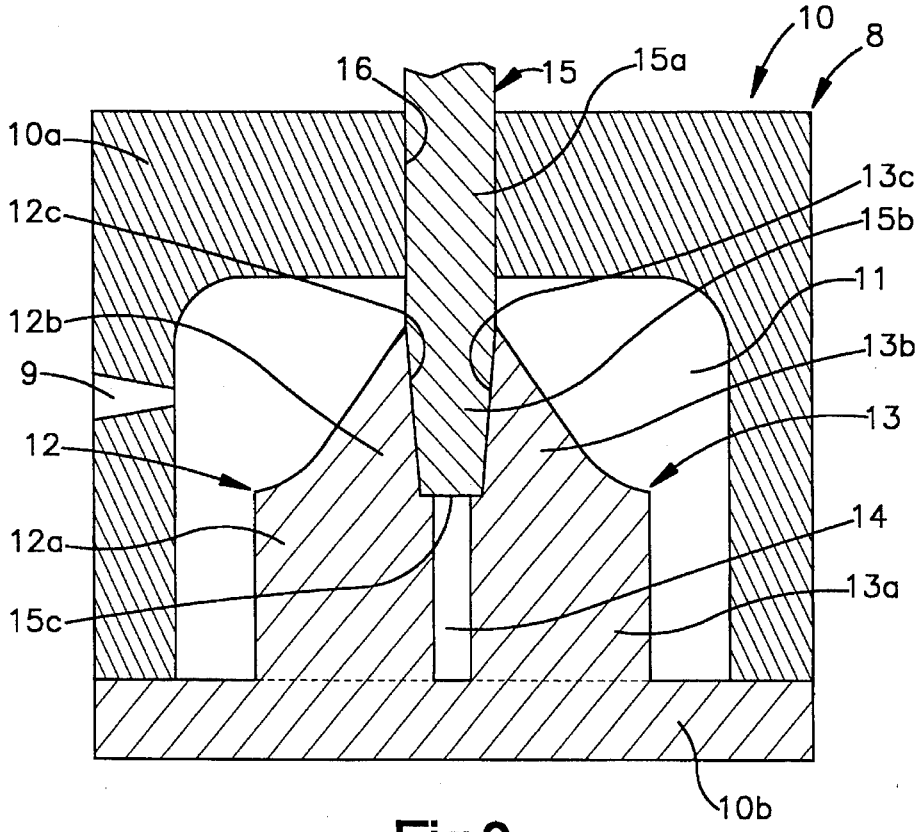
FIG. 2 is a vertical section of the mold as viewed along line II—II of FIG. 1, the mold being arranged to receive molten metal.

With reference to FIGS. 1 and 2, a mold 8 for a twin piston engine with an inlet 9 for molten metal includes an outer mold part 10, which is preferably formed out of steel, and consists of upper and lower sections 10*a*, 10*b*. The outer mold part 10 defines a mainly box-shaped mold cavity 11. The interior surfaces of the walls of the outer mold part 10, which are shown as flat surfaces, form the outside of the combined engine block and cylinder head. The walls can, however, have any suitable shape. For instance, they can be provided with recesses forming fins on the finished detail which, however, means that the outer mold part has to be divided into several sections in order to make it possible to separate the detail from the mold.

Contained within the mold cavity 11 are first and second inner mold parts, 12 and 13, respectively, which preferably are fixed to or are integrated with the lower section 10*b*. The inner mold parts 12, 13 each have a cylindrical lower portion 12*a*, 13*a*, and an upper portion 12*b*, 13*b*. The cylindrical lower portions 12*a*, 13*a* form or define the cylinder bores of the combined engine block and cylinder head. The upper portions 12*b*, 13*b* each form or define a part of a combustion chamber of the combined engine block and cylinder head. The first and second inner mold parts 12, 13 are spaced a distance from each other so that an intermediate space 14 is created therebetween. The intermediate space 14 is a part of the mold cavity 11 and forms or defines a partition wall between the cylinders during the casting procedure.

The intermediate space 14 is, at its upper part, enclosed by means of a third inner mold part 15 which has a circular upper portion 15*a*. A lower portion 15*b* of the third inner mold part 15 is shaped as a truncated cone, and has an end surface 15*c* which forms an upper limiting surface of the intermediate space 14. The third inner mold part 15 extends through a circular hole 16 in the upper section 10*a* of the outer mold part 10 and can be moved in its length direction in this hole 16. The hole 16 is located so that the third inner mold part 15 can be withdrawn from the finished detail parallel to, but in the opposite direction, with respect to the draw out direction of the first and second inner mold parts 12, 13.

The lower conical portion 15*b* of the third inner mold part 15 is, during the casting procedure, abutting corresponding recesses or sloping surfaces 12*c*, 13*c* provided in the upper portion 12*b*, 13*b* of the first and second inner mold parts 12, 13, as illustrated in FIG. 2.

It should be apparent that the third inner mold part 15 need not be cylinder-shaped, but can be of any suitable shape. The third inner mold part 15 can also be inserted into the mold cavity 11 from a direction different than that illustrated and described above without departing from the spirit and scope of the present invention as embodied in the claims appended hereto.

Figure 3:
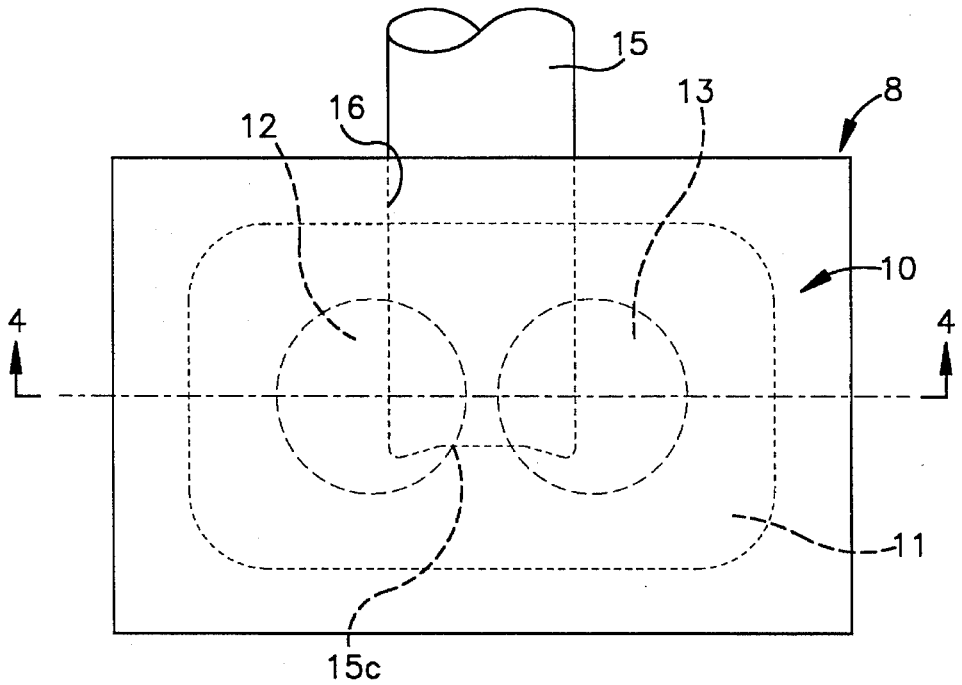
FIG. 3 is a top plan view of a mold according to a second preferred embodiment of the present invention.
Figure 4:
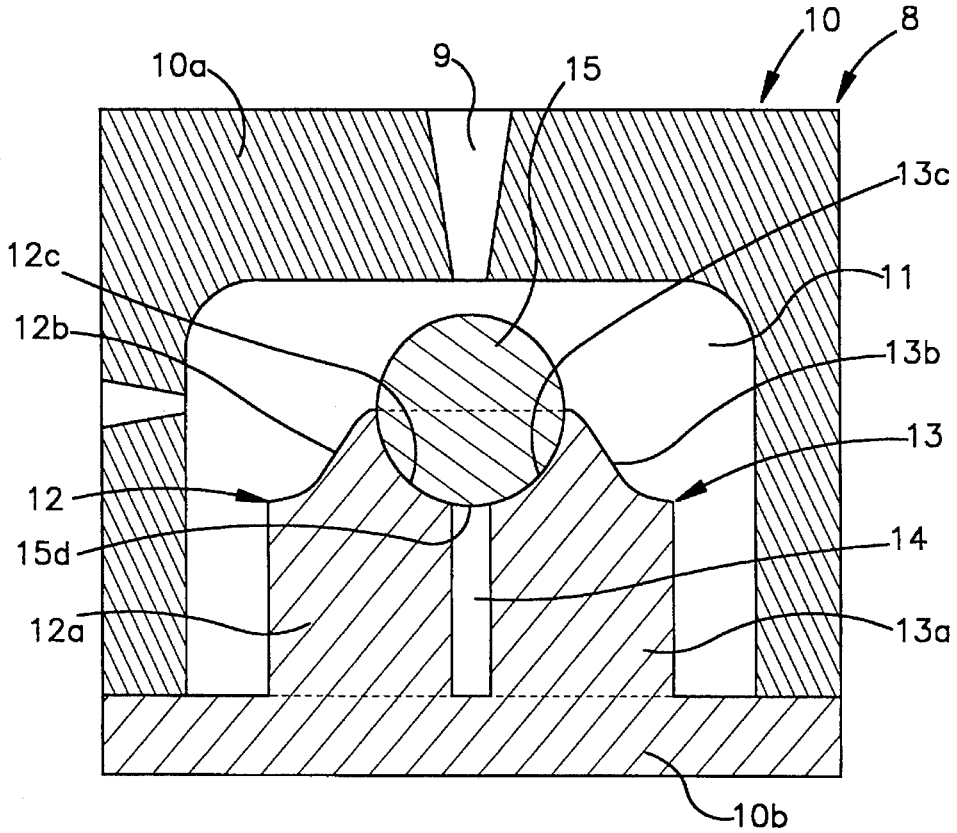
FIG. 4 is a vertical section of the second embodiment of the mold as viewed along line IV—IV of FIG. 3.

A second preferred embodiment of the present invention is illustrated in FIGS. 3 and 4 wherein common structural features are identified with the same reference numerals used in FIGS. 1 and 2. In this embodiment, the third inner mold part 15 is inserted into and withdrawn from the mold cavity 11 in a direction which is perpendicular to or transverse the length direction of the cylinders. In this case, a small lower portion 15*d* of the cylinder-shaped surface of the third inner mold part 15 serves as an upper limitation surface of the space 14 in the mold cavity 11, whereas, the end surface 15*c* rests against an abutment surface in the outer mold part 10. It would, of course, also be possible to divide the third inner mold part 15 into several sections which could be withdrawn in different directions.

It should also be mentioned that the hole formed by the third inner mold part 15 in the cast detail can easily be provided with threads and be used for installation of a spark plug (not shown).

The same press casting technique could also be used for creating a common combustion chamber for the cylinders in a twin piston engine where the cylinders are not parallel with respect to each other, in which case, the mold parts forming the cylinder bores have to be withdrawn in different directions.

The molds 8 illustrated in FIGS. 1–4 and described above are used to form, using the press-cast technique, a combined engine block and cylinder head for a twin-piston engine. The molds 8 are assembled by inserting the first and second inner mold parts 12, 13 into the mold cavity 11 of the upper section 10*a* of the outer mold part 10 and inserting the third inner mold part 15 through the opening or hole 16 in the upper section 10*a*. The lower section 10*b* of the outer mold part 10 abuts the upper section 10*a* and molten metal is allowed to be injected into the mold cavity 11 through the inlet 9 and flows around the inner mold parts 12, 13, 15. As such, the molds 8 according to the respective embodiments of the present invention are generally configured as illustrated in FIGS. 2 and 4.

After molten metal is injected or allowed to flow into the mold cavity 11 and around the inner mold parts 12, 13, 15, the molten metal is allowed to cool and solidify to form the combined engine block and cylinder head. Thereafter, the third inner mold part 15 is removed from the upper section 10*a* of the outer mold part 10, and the lower section 10*b* of the outer mold part 10, together with the first and second inner mold parts 12, 13, is moved away from the upper section 10*a*. The cast detail is then removed from the upper or lower section 10*a*, 10*b* of the outer mold part 10.

Although the preferred embodiments of this invention have been shown and described, it should be understood that various modifications and rearrangements of the parts may be resorted to without departing from the scope of the invention as disclosed and claimed herein.

What is claimed is:

1. A press casting method for producing a combined engine block and cylinder head for a twin piston engine, comprising the steps of:

providing an outer mold part having upper and lower sections which cooperate to define a mold cavity, one of said sections having a hole formed therein;

positioning first and second inner mold parts within said mold cavity, said first and second inner mold parts each defining a cylinder;

inserting a third inner mold part through said hole, said third inner mold part cooperating with said first and second inner mold parts to define a combustion chamber common to the cylinders;

introducing molten metal into the mold cavity, said metal flowing around the inner mold parts and filling the mold cavity;

allowing the molten metal to solidify to thereby form the combined engine block and cylinder head;

removing said inner mold parts from the combined engine block and cylinder head; and, removing the combined engine block and cylinder head from the outer mold part.

2. Method according to claim 1, further comprising the steps of:

maintaining the first and second inner mold parts a distance from one another, said third inner mold part defining at least a portion of an upper edge of a wall between the cylinders.

3. A mold in which a combined engine block and a cylinder head for a twin piston engine is press-cast, comprising an outer mold part (10) having walls which define a mold cavity (11), said walls defining an outer surface of the combined engine block and cylinder head during a casting procedure, first and second inner mold parts (12, 13) located within the mold cavity and spaced a distance from each other, said first and second inner mold parts each having a cylindrical portion (12*a*, 13*a*) which, during the casting procedure, forms a cylinder bore in the combined engine block and cylinder head, each of the first and second inner mold parts (12, 13) also comprising an upper portion (12*b*, 13*b*) provided relatively above the cylindrical portion and which, during the casting procedure, cooperate with a third inner mold part to form portions of a combustion chamber common to the cylinders, said third inner mold part (15) extending through the outer mold part (10) and into the mold cavity.

4. A mold according to claim 3, wherein the third inner mold part (15) is shaped as a symmetrical body.

5. A mold according to claim 4, wherein the third inner mold part (15) is shaped as an elongated cylindrical body having one end (15*b*) shaped as a truncated cone and cooperating with the first and second inner mold parts to define the combustion chamber.

6. A mold according to claim 3, wherein the mold parts are formed from steel or a steel alloy.

7. A mold according to claim 3, wherein the outer mold part (10) has upper and lower sections (10*a*, 10*b*).

8. A mold according to claim 7, wherein the first and second inner mold parts (12, 13) are secured to one of said upper and lower sections (10*a*, 10*b*).

9. A mold according to claim 8, wherein the third inner mold part (15) extends through an opening in said outer mold part (10).

10. A mold according to claim 9, wherein the third inner mold part (15) is shaped as a symmetrical body.

11. A mold according to claim 10, wherein the third inner mold part (15) is shaped as an elongated cylindrical body having one end (15*b*) shaped as a truncated cone and cooperating with the first and second inner mold parts to define the combustion chamber.

12. A mold according to claim 11, wherein the mold parts are formed from steel or a steel alloy.

* * * * *